US009500006B2

(12) United States Patent
Dayanikli et al.

(10) Patent No.: US 9,500,006 B2
(45) Date of Patent: Nov. 22, 2016

(54) EASILY MANAGED ELECTRONIC CABINET LOCK

(71) Applicants: Mustafa Dayanikli, Bursa (TR); Münir Büyükyazici, Bursa (TR); Vehbi Dayanikli, Bursa (TR)

(72) Inventors: Mustafa Dayanikli, Bursa (TR); Münir Büyükyazici, Bursa (TR); Vehbi Dayanikli, Bursa (TR)

(73) Assignee: VEMUS ENDUSTRIYEL ELEKTRONIK SANAYI VE TICARET LIMITED SIRKETI, Bursa (TR)

( * ) Notice: Subject to any disclaimer, the term of this patent is extended or adjusted under 35 U.S.C. 154(b) by 191 days.

(21) Appl. No.: 14/602,681

(22) Filed: Jan. 22, 2015

(65) Prior Publication Data

US 2016/0083978 A1 Mar. 24, 2016

(30) Foreign Application Priority Data

Sep. 24, 2014 (TR) ..... a 2014 11238

(51) Int. Cl.

| | |
|---|---|
| ***E05B 49/00*** | (2006.01) |
| ***E05B 47/06*** | (2006.01) |
| ***E05B 47/00*** | (2006.01) |
| ***E05C 3/12*** | (2006.01) |
| ***E05B 65/44*** | (2006.01) |
| *G07C 9/00* | (2006.01) |
| *E05C 3/04* | (2006.01) |

(52) U.S. Cl.

CPC ..... *E05B 47/0603* (2013.01); *E05B 47/0012* (2013.01); *E05B 47/0673* (2013.01); *E05B 65/44* (2013.01); *E05C 3/12* (2013.01); *G07C 9/00309* (2013.01); *G07C 9/00896* (2013.01); *E05B 2047/0056* (2013.01); *E05C 3/042* (2013.01); *G07C 2009/00634* (2013.01); *G07C 2009/00777* (2013.01); *G07C 2009/00793* (2013.01); *G07C 2009/00936* (2013.01)

(58) Field of Classification Search

CPC ..... E05B 47/0002; E05B 47/0012; E05B 47/02; E05B 47/023; E05B 47/06; E05B 47/0603; E05B 47/0673; E05B 2047/0014; E05B 2047/0017; E05B 2047/0018; E05B 2047/0048; E05B 2047/0054; E05B 2047/0056; E05B 2047/0082; E05B 2047/0084; E05B 63/0052; E05B 65/44; E05B 65/46; E05B 65/461; E05B 65/462; G07C 9/00309; G07C 2009/00769; G07C 2009/00777

See application file for complete search history.

(56) References Cited

U.S. PATENT DOCUMENTS

| | | | | |
|---|---|---|---|---|
| 6,145,353 | A * | 11/2000 | Doucet | E05B 47/0692 70/149 |
| 7,096,697 | B2 * | 8/2006 | Keightly | E05B 47/0012 292/142 |
| 7,096,698 | B2 * | 8/2006 | Walsh, III | E05B 47/0012 70/149 |
| 7,516,633 | B1 * | 4/2009 | Chang | E05B 13/101 292/251.5 |
| 7,918,114 | B2 * | 4/2011 | Walsh, III | E05B 47/0661 70/223 |
| 8,365,561 | B2 * | 2/2013 | Chang | E05B 47/02 292/142 |
| 8,495,898 | B2 | 7/2013 | Gokcebay | |
| 8,555,685 | B2 * | 10/2013 | Frolov | E05B 47/0673 292/137 |
| 8,931,315 | B2 * | 1/2015 | Frolov | E05B 47/0692 70/222 |
| 8,947,530 | B1 * | 2/2015 | Scalisi | E05B 47/0001 348/143 |
| 9,273,492 | B2 * | 3/2016 | Gokcebay | E05B 47/06 |
| 2006/0226948 | A1 * | 10/2006 | Wright | E05B 47/0673 340/5.25 |
| 2016/0053509 | A1 * | 2/2016 | Shiu | E05B 7/00 292/336.3 |

* cited by examiner

*Primary Examiner* — Christopher Boswell

(74) *Attorney, Agent, or Firm* — Egbert Law Offices, PLLC

(57) ABSTRACT

An electronic lock is provided to be used in drawers and cabinet doors made of metal, wood or plastic materials.

4 Claims, 7 Drawing Sheets

EASILY MANAGED ELECTRONIC CABINET LOCK

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an electronic cabinet lock which has been developed to be used in drawers and cabinet doors (covers) made of metal, wood or plastic materials.

2. Description of Related Art Including Information Disclosed Under 37 CFR 1.97 and 37 CFR 1.98

In the electronic lock systems used in the prior art, a microprocessor checks the validity of the commands entered by means of a keypad and performs the required functions. For instance, it allows checking the authenticity of the entered password and performing the opening process provided that the password is correct or changing the program parameters of the lock etc.

A password is required to be entered to be able to realize all the processes. It is necessary to enter a user or master password for the processes such as opening/closing, password-change, and parameter-change.

In order to change the program parameters, it is required to enter the master password first and then the parameter intended to be changed and the option thereof. This process needs to be repeated for each parameter. Therefore, the operational parameter adjustment of the locks is time-consuming and brings along excessive burden in the places where the number of locks is significantly high. Additionally, since each password-entering action causes battery consumption, it reduces the battery life and thus increases the waste batteries.

As a result of the patent search, the American patent application numbered U.S. Pat. No. 9,495,898B2 has been encountered. The disadvantages of the lock disposed in this application and of the other existing locks are specified below:

- The handle used in the existing electronic cabinet locks performs only the opening and closing functions. It has no other function. It mostly has a round/circular shape.
- The existing electronic cabinet locks have a 6×2 matrix key layout (6 rows and 2 columns). Therefore, other people looking from a certain distance can easily detect the entered password. This in turn causes a security gap. In general, the keypads are universal 4×3 matrix (4 rows and 3 columns). The phone keypads which have been widely used for many years and become standardized are 4×3 matrix. As 6×2 matrix configuration is non-standard, the use thereof is not ergonomic and it has inconveniences such as memorizing and entering the password.
- The lock body of the existing electronic cabinet locks is cone-shaped. That is to say, the width of the surface contacting with the door is more than the width of the surface confronting the front side and there are not any lateral protrusions due to the difficulties in molding method. This makes it difficult to use the lock body with the purpose of pulling the cabinet door.
- The battery cover of the existing electronic cabinet locks is disposed on the unsafe side of the lock body. The battery cover can be easily opened manually which should not be the case for a security product. This in turn causes safety gaps such as stealing the batteries and feeding high voltage from the battery contacts.
- The electronic circuit (PCB/Printed Circuit Board) containing the electronic circuits of the existing electronic cabinet locks does not comprise a Radio Frequency (RF) antenna configuration.
- The locking action is realized by rotating the handle toward the body in a standard way. The number of notches on the rotary shaft (allowing locking or unlocking) bearing the rotational motion is maximum two. For this reason, the lock is always rotated only in one direction. Hence, the locking action in the left doors is not toward the body but in the reverse direction and this, therefore, leads to confusion during the opening or closing processes.

In conclusion, due to the abovementioned drawbacks and inadequacy of the existing solutions with respect to the subject matter, it is deemed necessary to make a development in the relevant technical field.

BRIEF SUMMARY OF THE INVENTION

The present invention has been developed being inspired by the existing conditions and aims to solve the drawbacks discussed above.

The objects of the invention are disclosed below.

- An NFC (Near Field Communication) antenna is provided on the electronic circuit inside the body. The fact that a contactless information exchange can be carried out in this manner allows the electronic lock to be easily managed.
- Thanks to the energy harvesting outlet property of the dynamic NFC tag chip provided on the electronic circuit, the electronic lock can be programmed even when a battery is not inserted into the electronic lock.
- Thanks to the fact that the electronic lock is NFC-compatible, it can communicate with the devices such as NFC-enabled PDA (Personal Digital Assistant), mobile phone, tablet computer, smart clock or the like and thus it can be managed by means of these devices. NFC communication is completed in a very short time when compared to the time consumed for password-entering. Hence, a significant amount of saving on battery consumption within the lock is achieved. This renders the product environmentally-friendly.
- The handle comprises a socket so as to house a coil antenna therein. Thus, the lock can be used and managed together with RF tags in a contactless manner.
- The handle comprises a socket so as to house an antenna (strip type) therein. Thus, the lock can be used and managed together with RF tags in a contactless manner.

The handle has a structure to be able to move up/down in a way to push a hidden button thereunder. Said button is activated by pushing down the handle and various functions can be performed in this manner. The primary ones of these functions are as follows: waking up the electronic circuit, preparing for card-reading, confirming the functions etc. Hence, the functions increasing the battery consumption are only activated when needed and this contributes to the long battery life.

In order to fulfill the preceding objects, an electronic lock has been developed which is used in the doors, covers or drawers and comprises:

- in order to allow closing the door, cover or drawer, a latch which connects the electronic lock with the door frame or the cabinet,
- a rotary shaft which drives said latch and comprises rotary shaft notches located thereon and having recesses therebetween,
- a roller in which said rotary shaft is located and which enables the electronic lock to be mounted to the door/cover/drawer,
- a micro-motor latch which avoids the motion of the rotary shaft by entering into the recesses between said rotary shaft notches or enables the motion of the rotary shaft by coming out of the recesses,
- a motion transfer member which moves said micro-motor latch upward or downward,
- a spring gear which is connected to said motion transfer member,
- a linear motion transfer member which is connected to said spring gear,
- a worm screw gear on which said linear motion transfer member moves during rotating,
- a micro-motor which rotates said worm screw gear,
- a handle which is rotated by the user and connected to the rotary shaft in order to enable said rotary shaft to rotate,
- an NFC antenna which is provided on an electronic circuit and allows the signals, which contain therein the functions intended to be realized in the electronic lock and administrator password information and sent by means of the software within the NFC-enabled mobile device, to be detected,
- a dynamic NFC tag chip which is provided on said electronic circuit and connected to said NFC antenna and in which the information, contained by the signals sent by said mobile device and received through the RF wave by means of said NFC antenna, is saved on the memory therein, and which activates the processor by transferring the energy, which it produces from said RF wave by means of the energy harvesting outlet, into the feed inlet of the processor by means of a rectifier,
- said processor which is connected to the dynamic NFC tag chip; reads the information inside the memory of said dynamic NFC tag chip by means of the software therein and in response to this information, records data again into the memory of dynamic NFC tag chip or activates said micro-motor; and obtains the information suggesting that the handle is in open position or closed position as a result of the contact between the contact points in different positions on the rotary contact and the electronic circuit.

All structural and characteristic features and all the advantages of the invention will be more clearly understood thanks to the following figures and detailed description composed with reference to these figures and for this reason, it is necessary that the evaluation be done by taking into consideration these figures and detailed description.

BRIEF DESCRIPTION OF THE SEVERAL VIEWS OF THE DRAWINGS

In FIG. 7, the arrow illustrated between the dynamic NFC tag chip and the microprocessor refers to the serial communication between the dynamic NFC tag chip and the microprocessor.

DESCRIPTION OF PART REFERENCES

Figure 1:
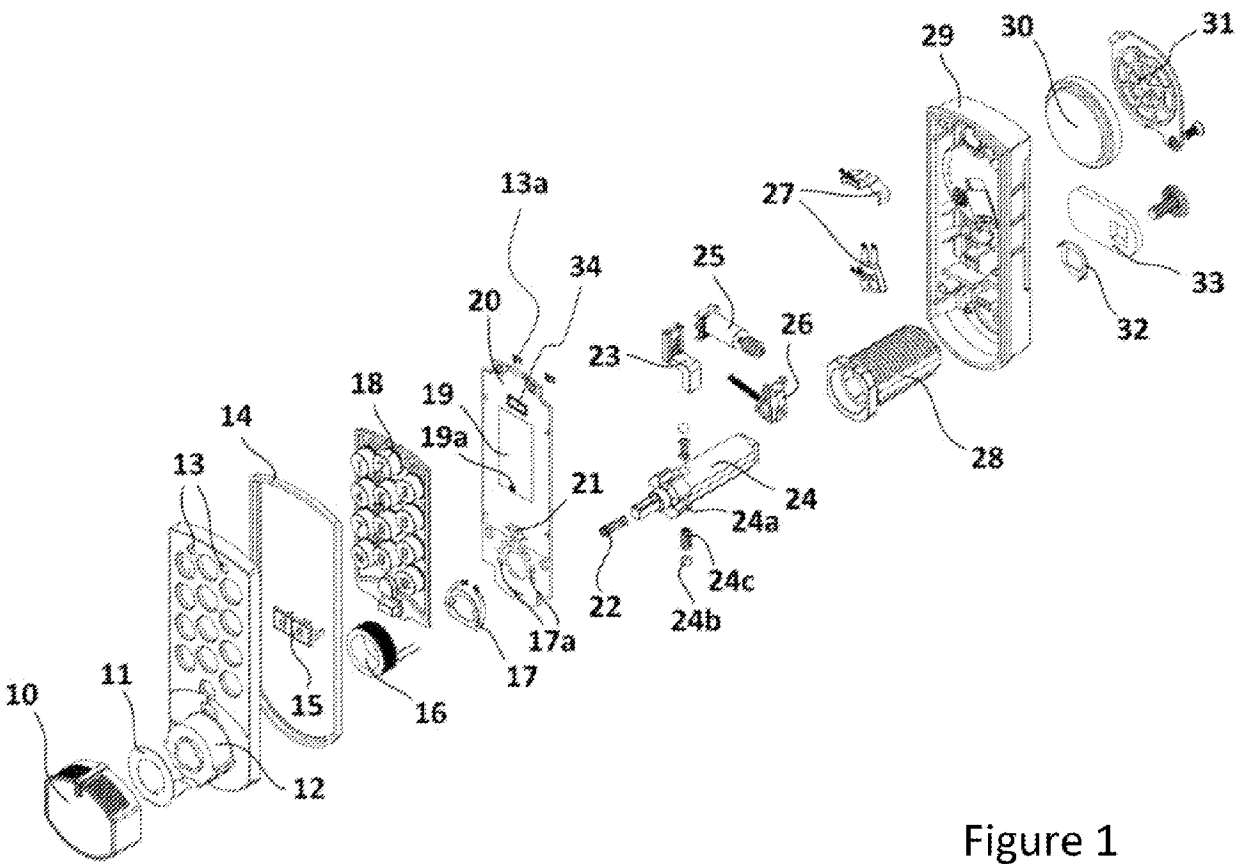
FIG. 1 is the demounted perspective view of the electronic lock according to the invention.
Figure 2B:
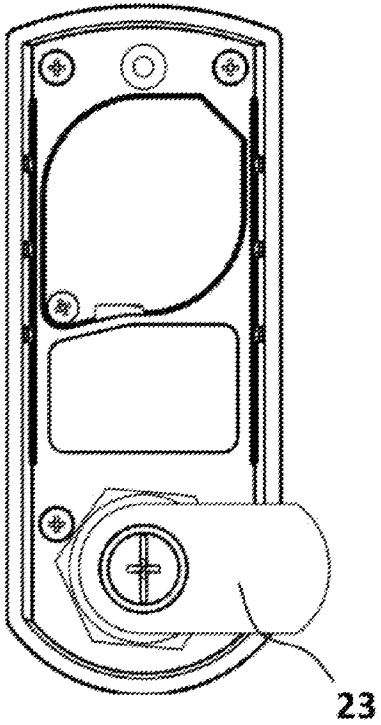
FIG. 2*b* is the rear two-dimensional view of the electronic lock according to the invention.
Figure 2A:
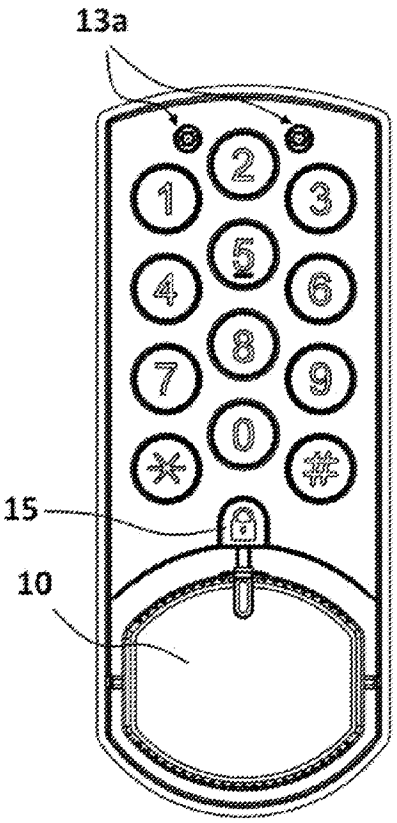
FIG. 2*a* is the front two-dimensional view of the electronic lock according to the invention.
Figure 3B:
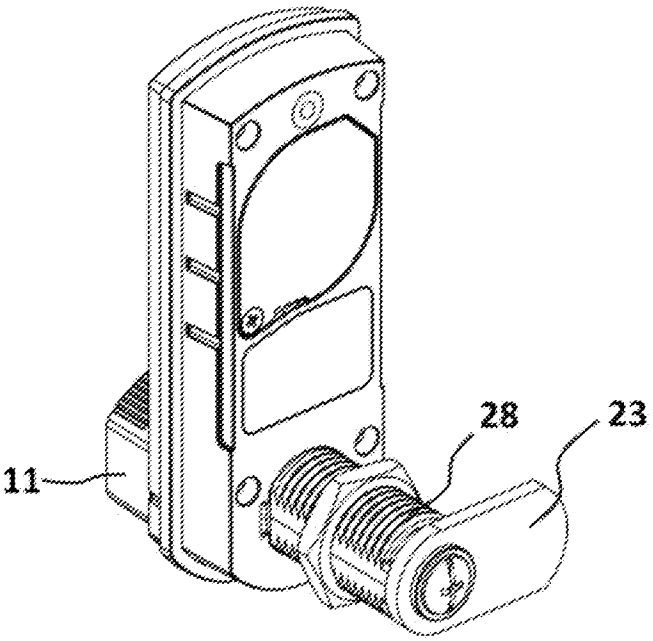
FIG. 3*b* is the rear perspective view of the electronic lock according to the invention.
Figure 3A:
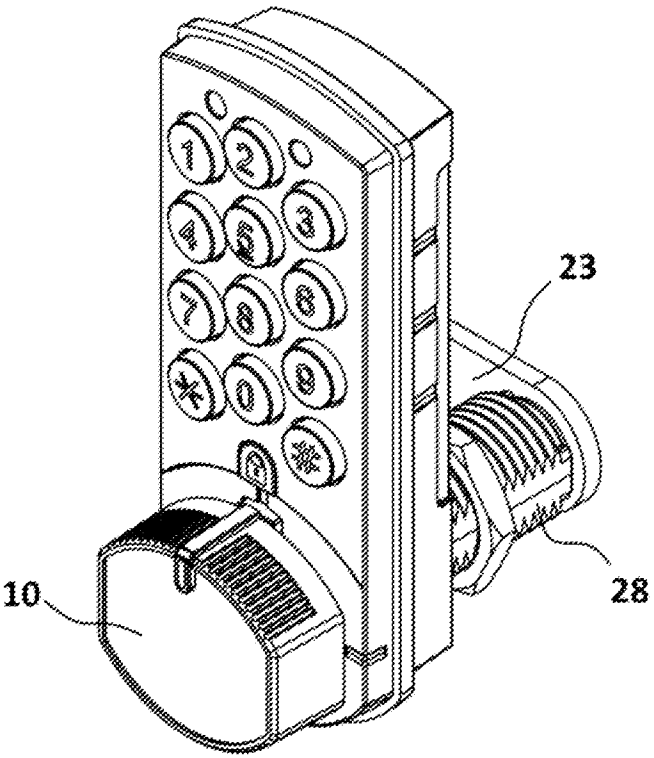
FIG. 3*a* is the front perspective view of the electronic lock according to the invention.
Figure 4B:
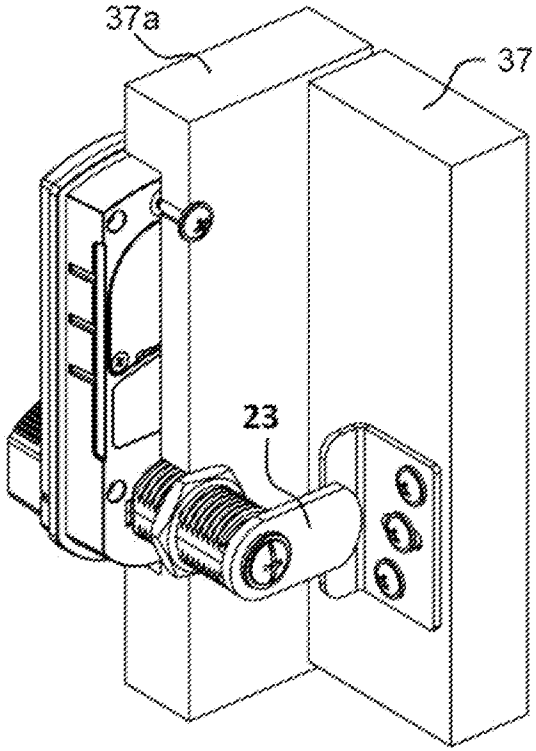
FIG. 4*b* is the rear perspective view of the electronic lock according to the invention when mounted to the cover/door.
Figure 4A:
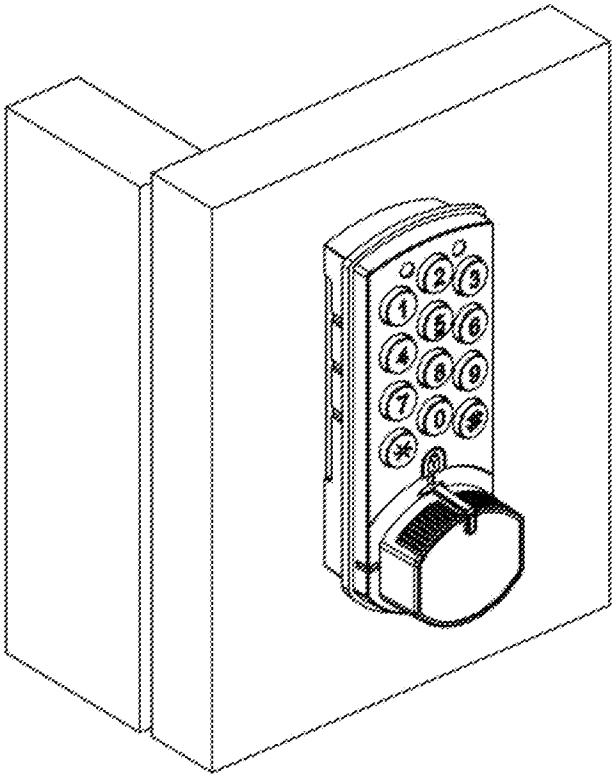
FIG. 4*a* is the front perspective view of the electronic lock according to the invention when mounted to the cover/door.
Figure 5:
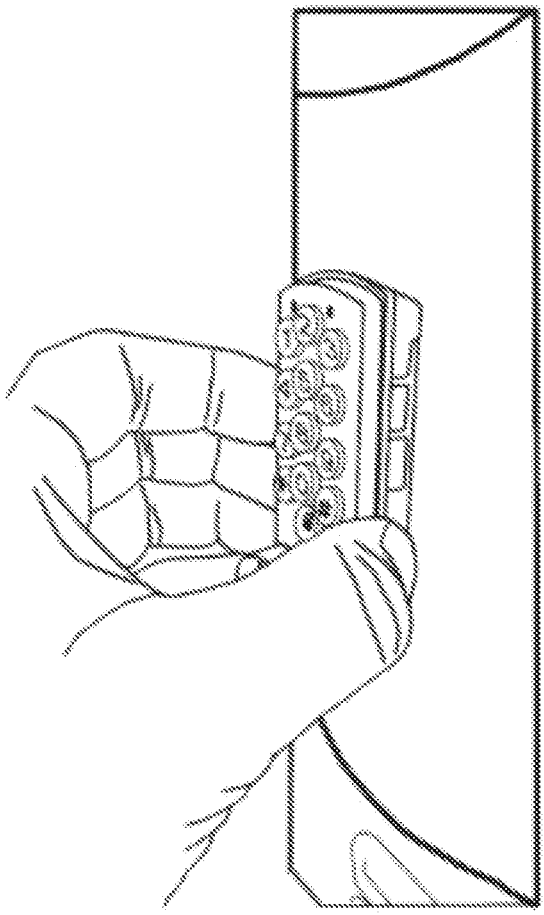
FIG. 5 is the drawing where the electronic lock is held by a user when mounted to the cover/door in order to enable the size of the electronic lock according to the invention to be comprehended.
Figure 6B:
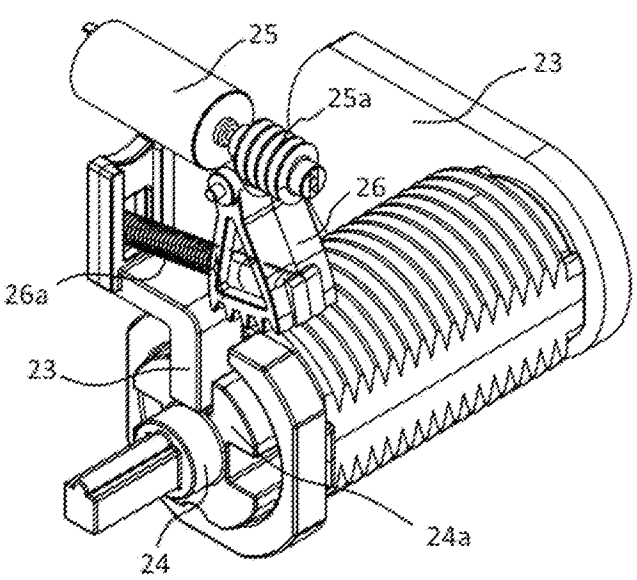
FIG. 6*b* is the drawing which illustrates the position of the components, i.e. micro-motor latch, rotary shaft, micro-motor and spring gear, when the electronic lock according to the invention is in closed position.
Figure 6A:
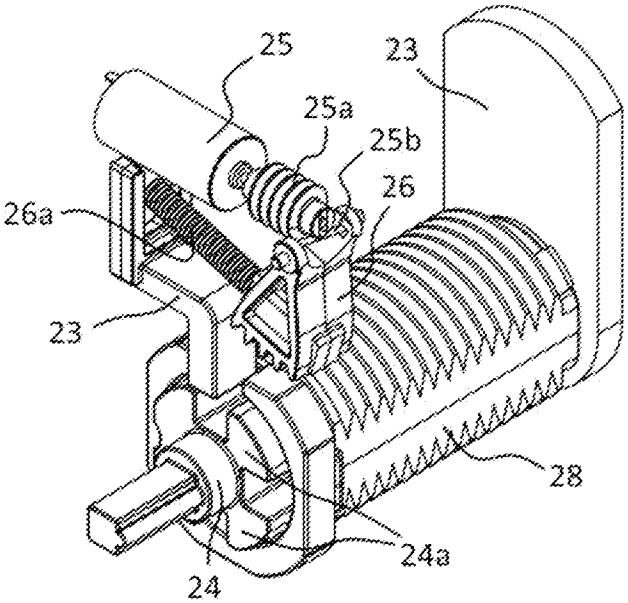
FIG. 6*a* is the drawing which illustrates the position of the components, i.e. micro-motor latch, rotary shaft, micro-motor and spring gear, when the electronic lock according to the invention is in open position.
Figure 7:
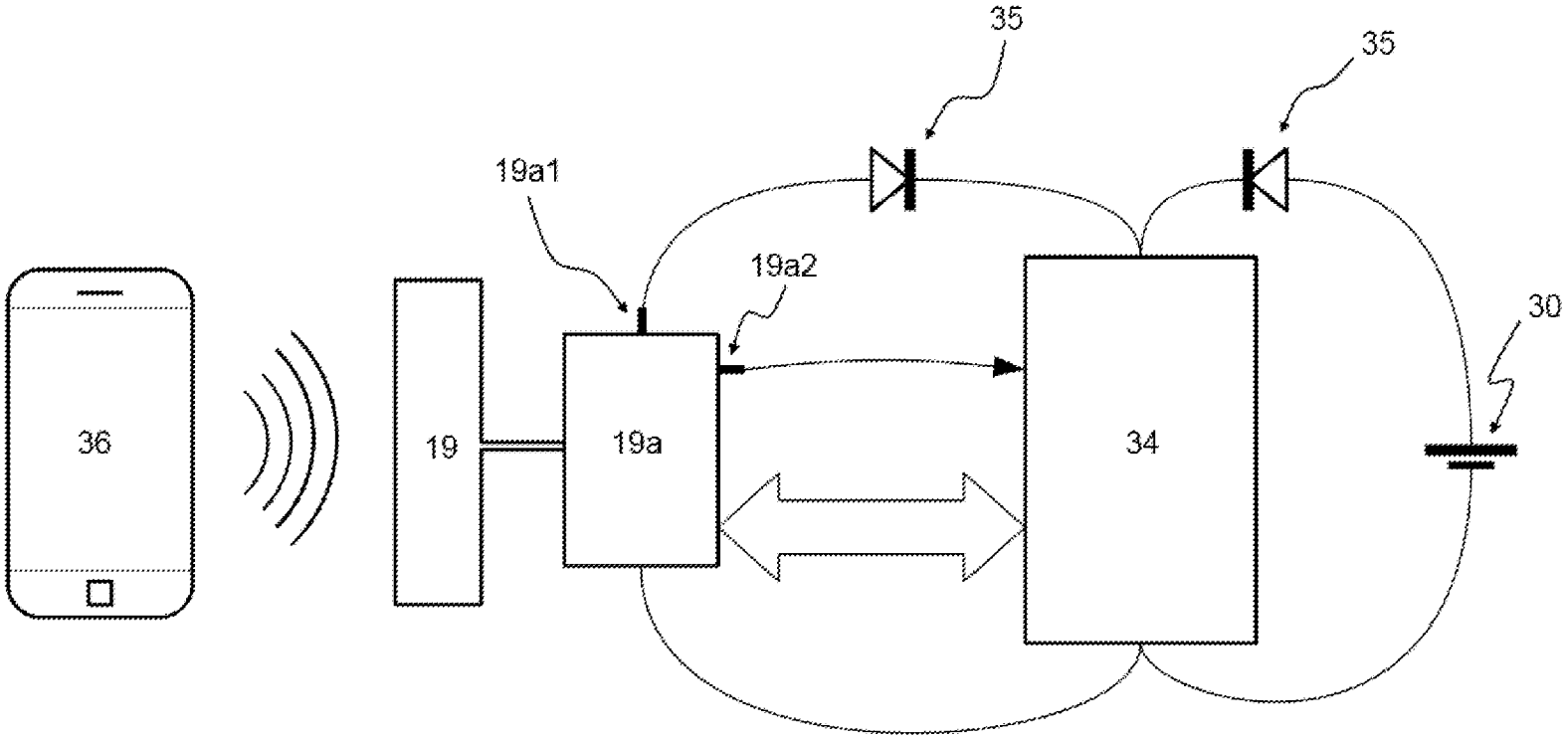
FIG. 7 is a drawing which illustrates the communication between the mobile device, dynamic NFC tag chip and the microprocessor.

10. Handle
11. Antenna
12. Antenna socket
13. Status indicator housing
13*a*. Status indicators
14. Frame
15. Locked-unlocked indicator
16. Coil antenna
17. Rotary Contact
17*a*. Contact points
18. Keypad
19. NFC antenna
19*a*. Dynamic NFC tag chip
19*a*1. energy harvesting outlet
19*a*2. busy status indicator outlet
20. Electronic circuit
21. Handle button
22. Handle spring
23. Micro-motor latch
24. Rotary shaft
24*a*. Rotary shaft notches
24*b*. Positioning ball
24*c*. Ball compression spring
25. Micro-motor
25*a*. Worm screw gear
25*b*. Linear motion transfer member
26. Spring gear
26*a*. Motion transfer member
27. Battery contacts

28. Roller
29. Lock body
30. Battery
31. Battery cover
32. Left/Right Selector Cam
33. Latch
34. Processor
35. Rectifier
36. Mobile device
37. Cabinet
37*a*. Door The drawings do not need to be scaled necessarily and the details that are not necessary for the understanding of the present invention may have been ignored. Apart from this, the elements that are at least substantially identical or that have at least substantially identical functions are shown with same numbers.

DETAILED DESCRIPTION OF THE INVENTION

Within this detailed description, the preferred embodiments of the lock according to the invention are disclosed only for the better understanding of the subject.

The features of the components comprised by the electronic lock according to the invention are stated below:

The handle (10) is the component which allows the lock to be used. The antenna socket (12) is located inside the handle (10). The handle (10) further functions as a hidden button since it prevents the handle button (21) located therebehind from being seen. As the handle (10) has an elliptical form, the power transfer can be realized ergonomically without any finger slip in order to rotate the handle (10). Owing to this form thereof, the handle (10) helps the locked/unlocked position thereof to be realized from a certain distance.

The antenna (11) which is provided on the electronic circuit and is preferably a PCB antenna (antenna type placed on the electronic circuit) or a strip antenna (antenna type connected to the electronic circuit) allows a contactless (RF: radio frequency) information exchange and lock operation. The antenna (11) is located inside the handle (10).

The status indicators (13*a*) are preferably LED and located inside the status indicator housings (13). The status indicators (13*a*) and the components providing energy supply in the event that a battery dies or malfunctions are integrated with the electronic circuit (20) and provided on the electronic circuit (20). In this manner, the functionality is provided without any need for additional component.

The frame (14) enables the lock body (29) to function as a handle. The frame (14) is semi-inbuilt type. Thanks to the frame (14), the lock body (29) is mounted to the cover/door (37*a*)—where it is applied—in a semi-inbuilt manner. It reduces the protrusion height from the mounting surface thanks to the semi-inbuilt mounting thereof. Moreover, it provides an aesthetic look as it makes the visible volume smaller. Hence, an alternative mounting option is provided for those who mount the lock.

The locked/unlocked indicator (15) shows that the electronic lock is locked or unlocked (position thereof). The locked/unlocked indicator (15) can change in a synchronized manner with the handle (10). In this manner, the status information (position) can be provided to the user without consuming energy. The locked/unlocked indicators (15) can give information to the user when needed by being lightened up with a light from below for a limited time period during position changes or with the purpose of warning. The elliptical form of the handle (10) facilitates to understand easily whether the lock is open or closed when looked from a certain distance. In safe position, the lock handle (10) has a visual quality in harmony with the lock body (29). In unsafe position, however, this harmony is disturbed and warns the user by drawing attention.

The coil antenna (16) is located inside the antenna socket (12) provided inside the handle (10) and allows RF communication and RFID card-reading.

The rotary contact (17) enables the processor (34) to identify the position of the handle (10). When the handle (10) is rotated, the rotary contact (17) also rotates. The processor (34) obtains the information suggesting that the handle (10) is in open position or closed position as a result of the contact between the contact points (17*a*) in different positions on the rotary contact (17) and the electronic circuit (20). A highly cost-efficient position identification can be done owing to the rotary contact (17). Furthermore, thanks to the rotary contact (17), the processor (34) detects a situation where the handle (10) is exposed to a tricky manipulation and the rotary contact (17) allows taking precaution for the lock to maintain the safe position thereof. The rotary contact (17) and the contact points (17*a*) eliminate the use of a plurality of switches as in the prior art. Therefore, a serious amount of saving on material cost is achieved. As a result, the world resources are used in lesser amounts and an electronic lock is developed which is not breaks down easily.

The keypad (18) allows entering the password. The keypad layout (18) is universal. Using 4×3 matrix (4 rows and 3 columns), which is a common and conventional configuration, increases the ergonomics for the user. Besides, it provides an easy usage for the users with big fingers thanks to the arc-like (the axis of the middle column being a little bit above) layout of the rows. In addition, the arc-like layout of the keys makes it difficult to identify the entered password by an outside person.

NFC antenna (19) is connected to the dynamic NFC tag chip (19*a*) and enables NFC (Near Field Communication) communication with the mobile devices (36).

The electronic circuit (20) contains thereon the electronic equipment of the electronic lock.

The handle button (21) allows the handle (10) to function as a button.

The handle spring (22) allows the handle (10) to assume the former position thereof when pushed and released.

The micro-motor latch (23) avoids or allows the rotary shaft (24) to rotate.

The rotary shaft (24) transfers the motion of the handle (10) to the micro-motor latch (23).

The rotary shaft notches (24*a*) allows the positioning of the electronic lock to the left/right doors (37*a*). The locking action is realized by rotating the handle (10) toward the cabinet body in a standard way. The number of rotary shaft notches (24*a*) on the rotary shaft (24) bearing the rotational motion (allowing locking or unlocking) is three. Hence, locking both in left and right doors (37*a*) is achieved by rotating the handle (10) toward the cabinet body. This is determined based on the positions of the left/right selector cam (32) and rotary contact (17).

The positioning ball (24*b*) allows the rotary shaft (24) to be easily positioned.

The ball compression spring (24*c*) allows the rotary shaft (24) to be positioned by means of the positioning ball (24*b*).

The micro-motor (25) controls the motion of the rotary shaft (24) by means of the micro-motor latch (23).

The spring gear (26) transfers the motion of the micro-motor (25) to the micro-motor latch (23).

The battery contacts (27) allow the battery (30) to contact the electronic circuit (20).

The roller (28) houses the rotary shaft (24) therein and allows the electronic lock to be mounted to the door.

The lock body (29) comprises therein most of the components of the electronic lock including the electronic circuit (20). The frame (14) placed around the lock body (29) forms a protrusion outward from the lock body (29). A comfortable handling is provided by filling the space between the frame (14) and the door (37*a*) with the fingers. This in turn facilitates the cabinet (37) door (37*a*) or the drawer to be opened by being pulled.

The battery (30) enables the electronic circuit (20) to operate.

The battery cover (31) is the section where the battery (30) is placed. As the battery cover (31) is located behind the lock body (29), it is in the safe section. In this manner, the battery (30) is prevented from being stolen, changed and manipulated.

The left/right selector cam (32) has a function of adjusting the electronic lock with respect to the left or right cover/door (37*a*). The electronic lock can be mounted to the doors (37*a*) depending on the way of placing the left/right selector cam (32) and the position of the rotary shaft notches (24*a*) provided on the rotary shaft (24).

The latch (33) allows locking or unlocking the cover/door (37*a*).

The energy harvesting outlet (19*a*1) of the dynamic NFC tag chip (19*a*) is connected to the feed inlet of the processor (34) by means of a rectifier (diode) (35) and the energy produced by means of the energy harvesting outlet (19*a*1) is transferred to the feed inlet of the processor (34) by means of said rectifier (35). The battery (30) is also connected to the feed inlet of the processor (34) by means of a rectifier (35). Thus, not only the feeds are prevented from overlapping when the output voltages of the battery (30) and the dynamic NFC tag chip (19*a*) are at different levels but also any quiescent current flow from the battery (30) is avoided when the dynamic NFC tag chip (19*a*) is not active. Additionally, the processor (34) is activated by providing feed inlet to the processor (34) by means of the energy harvesting outlet (19*a*1) if any feeding energy cannot be supplied to the electronic circuit (20) or the battery (30) dies.

The mobile device (36) is an NFC-enabled device, i.e. mobile phone, smart clock, PDA (Personal Digital Assistant), tablet computer or the like.

The electronic lock according to the invention comprises a processor (34) which is provided on the electronic circuit (20) and connected to the dynamic NFC tag chip (19*a*). Furthermore, an NFC antenna (19) integrated with the electronic circuit (20) is provided on the electronic circuit (20). In addition, a dynamic NFC tag chip (19*a*) is disposed on the electronic circuit (20). The word "dynamic" means that there is an NFC antenna (19) connected to the dynamic NFC tag chip (19*a*) located on the electronic circuit (20). The feature of the dynamic NFC tag chip (19*a*) is that the dynamic NFC tag chip (19*a*) runs thanks to the creation of a voltage on the NFC antenna (19) by the RF wave created by the phone when said dynamic NFC tag chip runs into an NFC-enabled mobile phone. Also, the sign in said RF wave is taken and transferred to the dynamic NFC tag chip (19*a*) by means of the NFC antenna (19) and written to the memory of the dynamic NFC tag chip (19*a*). By processing according to the information on the received sign, a response is sent to the reader device, namely the mobile phone again by means of the NFC antenna (19).

In the existing NFC-enabled devices, 2 devices are drawn closer to each other and the devices communicate with each other in 13.56 MHz frequency. This communication is realized as follows: a special integration which is called "transceiver" (receiver-transmitter communication device) and has a feature of being both a receiver and a transmitter is provided in both devices. The dynamic NFC tag chip used in the electronic lock according to the invention does not have any feature of being both a receiver and a transmitter. Only when it communicates with an NFC-enabled mobile device (36) or an NFC reader device comprising a receiver-transmitter communication device therein, it can respond to this device. The dynamic NFC tag chip (19*a*) alone cannot send out a sign or signal without a device with said features. The disadvantage for this is that the electronic lock cannot be used with an NFC-compatible card. In order to use the electronic lock, it is necessary to use a receiver-transmitter communication device thereon instead of a dynamic NFC tag chip (19*a*) or to wire a circuit with the features of the receiver-transmitter communication device.

The features of the dynamic NFC tag chip (19*a*):

Having a memory varying between 512 bytes and 800 kb,

Comprising thereon a voltage-producing port, namely energy harvesting outlet (19*a*1) provided that an RF/NFC-compatible device gets closer, Comprising a port, namely busy status indicator outlet (19*a*2) informing about the RF communication while performing thereof, Comprising $I^2C$ (Inter-Integrated Circuit) port, Comprising ports where the antenna connection is realized.

The electronic lock according to the invention uses the memory section and the data written to the memory of the dynamic NFC tag chip (19*a*) as a communication means. There is no direct RF communication between the dynamic NFC tag chip (19*a*) and the mobile device (36) (mobile phone). The mobile device (36) writes data to the memory of the dynamic NFC tag chip (19*a*) by means of the software contained therein. And, the processor (34) writes data to the memory or processes in response to the data registered by the mobile device (36) by means of the software installed therein and then reads what is written to the memory of the dynamic NFC tag chip (19*a*) again by means of the mobile device (36).

$I^2C$ communication protocol is used in the dynamic NFC tag chips (19*a*). The dynamic NFC tag chip (19*a*) can also be connected to the processor (34) with 2 ports. The advantages of the dynamic NFC tag chips (19*a*) when compared to the passive NFC chips are that after entering an NFC area, the dynamic NFC tag chip (19*a*) harvests the energy in the Radio Frequency wave and produces voltage at the outlet thereof by means of a pin. The object of the invention is also to use the voltage value at the outlet of the dynamic NFC tag chip (19*a*) for the operation of the processor (34). Furthermore, the dynamic NFC tag chips have outlets with "busy or not" feature, namely busy status indicator outlet (19*a*2). This outlet is also connected to the processor (34). If the mobile device (36) writes data to the memory of the dynamic NFC tag chip (19*a*) by means of the software contained therein, the processor (34) receives this information by means of this port (outlet). When the mobile device (36) completes the writing process, the processor (34) reads the data on the memory of the dynamic NFC tag chip (19*a*) with the $I^2C$ port and by reading the data written by the mobile device (36), performs the functions related to this data. These functions may be changing the operation parameters, changing the opening-closing mode, changing the warning mode etc. Or, for example, the processor (34) writes certain number of instances happened in the past to the memory of the dynamic NFC tag chip (19*a*) and mobile device (36) reads that data from the memory by means of the software contained therein and obtains information such as the password with which the lock is unlocked 1 hour ago, password change performed 2 hours ago, and wrong password entrance 5 hours ago. That is to say, the retroactive information can be interrogated.

When the mobile device (36) is drawn closer to the electronic lock, the dynamic NFC tag chip (19*a*) transmits the energy (having a value of 3V) which it harvested through the RF wave by means of the NFC antenna (19) into the processor (34) through the energy harvesting outlet (19*a*1). The processor (34) operates and understands that the energy is coming from the dynamic NFC tag chip (19*a*). The processor (34) then interrogates the "busy or not" port, namely the busy status indicator outlet (19*a*2) of the dynamic NFC tag chip (19*a*). When the busy status of the dynamic NFC tag chip (19*a*) ends, the busy status indicator outlet (19*a*2) changes position thereof and the processor (34) reads the memory of the dynamic NFC tag chip (19*a*) and fulfills the commands (Is it going to operate in the individual use, is it going to operate in the multiple use, is the voice going to be active or passive etc.?) related thereto.

In the preferred embodiment where the dynamic NFC tag chip (19*a*) and NFC antenna (19) are used, if the password entered by the user is correct, the following processes are realized during the opening process of the lock:

The processor (34) engages—that is to say, activates—the micro-motor (25), Micro-motor rotates the worm screw gear (25*a*), The linear motion transfer member (25*a*) on the spring gear (26) moves on the worm screw gear (25*a*) in the opposite of the direction where the micro-motor (25) is disposed, During said motion of the linear motion transfer member (25*b*), the motion transfer member (26*a*) connected to the spring gear (26) moves the micro-motor latch (23) upward, Upon the downward motion of the micro-motor latch (23), the micro-motor latch (23) comes out of the rotary shaft notches (24*a*), The user rotates the rotary shaft (24) toward the opening direction and the cover/door (37*a*) or the drawer is opened.

The following processes are realized during the closing process of the electronic lock:

The user rotates the rotary shaft (24) toward the closing direction,

The processor (34) engages—that is to say, activates—the micro-motor (25), Micro-motor (25) rotates the worm screw gear (25*a*), The linear motion transfer member (25*b*) on the spring gear (26) moves on the worm screw gear (25*a*) in the direction where the micro-motor (25) is disposed, During said motion of the linear motion transfer member (25*b*), the motion transfer member (26*a*) connected to the spring gear (26) moves the micro-motor latch (23) downward, Upon the downward motion of the micro-motor latch (23), the micro-motor latch (23) enters into the recess between the rotary shaft notches (24*a*), and the cover/door (37*a*) or the drawer is closed thereby.

The processes during opening and closing mentioned above are not new features and have been described in the US patent application numbered U.S. Pat. No. 8,671,723 B2 and filed by the same applicant VEMUS ENDUSTRIYEL ELEKTRONIK SANAYI VE TICARET LIMTED SIRKETI.

The mobile device (36) performs the following functions on the dynamic NFC tag chip (19*a*) by means of the software installed therein:

Changing or reading the program parameters of the electronic lock,

Changing the passwords defined in the electronic lock,

Reading the incidents happened in the electronic lock,

Naming, defining, addressing the electronic lock,

Opening, closing the electronic lock.

In the electronic lock according to the invention, provided that the entered password is correct in the electronic lock, the handle (10) connected to the rotary shaft (24) released is rotated by the user. The rotary contact (17) connected to the handle (10) changes position and contacts the contact points (17*a*) on the electronic circuit depending on the new position thereof. The processor (34) engages or disengages the micro-motor (25) according to the signs coming from the contact points (17*a*).

In the other preferred embodiments of the electronic lock according to the invention, an antenna (11) or coil antenna (16) can be provided in addition to the dynamic NFC tag chip (19*a*) and NFC antenna (19) in a manner connected to the electronic circuit (20). For, NFC antenna (19) is away from the coil antenna (16) and they do not affect each other. However, the antenna (11) and the coil antenna (16) cannot be located on the electronic circuit (20) at the same time. It is because the operating frequencies thereof affect the operating thereof.

The embodiment of the electronic lock which comprises a coil antenna (16) thereon is used with a proximity card containing an RF tag operating in 125 kHz frequency. Said proximity card containing RF tag can also be located inside a key chain, watch, bracelet etc. Since the frequency is 125 kHz, extra wound wire is required. For this reason, the coil antenna (16) is used. Closing process of the electronic lock which is open in this embodiment is realized as follows. First of all, the handle (10) is pushed with the proximity card and thus the handle (10) also pushes backward the handle button (21) provided therebehind. Upon this pushing action, the processor (34) detects that there is a contact to the handle button (21) and the coil antenna (16) is activated. The processor (34) reads the information on the RF tag inside the card/key chain by means of the coil antenna (16). The user enters the password and rotates the handle (10) preferably within 5 seconds and switches the same to closed position. Provided that the entered password and the password previously-defined on the RF tag are correct, the micro-motor latch (23) enters between the rotary shaft notches (24*a*) with the motion of the micro-motor (25) and the electronic lock is locked (provided that the password is wrong, it gives an error alert). In order to re-unlock the electronic lock, first of all, the handle (10) is again pushed by means of the proximity card used during closing of the electronic lock and thus the handle (10) also pushes backward the handle button (21) provided therebehind. Upon this pushing action, the processor (34) detects that there is a contact to the handle button (21) and the coil antenna (16) is activated. The processor (34) reads the information on the RF tag inside the card/key chain by means of the coil antenna (16). The user enters the password. Provided that the entered password and the password previously-defined on the RF tag are correct, the micro-motor latch (23) comes out of the rotary shaft notches (24*a*) with the motion of the micro-motor (25) and the electronic lock is unlocked. The user rotates the handle (10) in the reverse of the closing direction preferably within 5 seconds and switches the same to open position.

The embodiment of the electronic lock which comprises an antenna (11) thereon that is preferably flexible is operated with an NFC-compatible card containing an RF chip therein and operating with 13.56 MHz. The NFC-compatible card can preferably be a Mifare or DESFire card. Closing process of the electronic lock which is also open in this embodiment is realized in a way similar to the embodiment comprising a coil antenna (16). First of all, the handle (10) is pushed with the NFC-compatible card and thus the handle (10) also pushes backward the handle button (21) provided therebehind. Upon this pushing action, the processor (34) detects that there is a contact to the handle button (21) and the antenna (11) is activated. The processor (34) reads the information on the RF tag inside the card by means of the antenna (11). The user enters the password and rotates the handle (10) preferably within 5 seconds and switches the same to closed position. Provided that the entered password and the password previously-defined on the RF tag are correct, the micro-motor latch (23) enters between the rotary shaft notches (24*a*) with the motion of the micro-motor (25) and the electronic lock is locked (provided that the password is wrong, it gives an error alert). In order to re-unlock the electronic lock, first of all, the handle (10) is again pushed by means of the same NFC-compatible card used during closing of the electronic lock and thus the handle (10) also pushes backward the handle button (21) provided therebehind. Upon this pushing action, the processor (34) detects that there is a contact to the handle button (21) and the antenna (11) is activated. The processor (34) reads the information on the RF tag inside the card by means of the antenna (11). The user enters the password. Provided that the entered password and the password previously-defined on the RF tag are correct, the micro-motor latch (23) comes out of the rotary shaft notches (24*a*) with the motion of the micro-motor (25) and the electronic lock is unlocked. The user rotates the handle (10) in the reverse of the closing direction preferably within 5 seconds and switches the same to open position.

The cabinets (37) in the areas such as public sports facilities and swimming pools are among the usage areas of the electronic lock. In such places, the same cabinet (37) is used by many people in different times. In addition to said multiple use, the cabinets (37) may be in individual use. Only one person knows the lock password in the individual use. If s/he forgets the password, s/he cannot change it and cannot create a new password. It is required to know the last password to be able to change the password.

In the multiple use, on the other hand, "1234" is entered as the password for the electronic lock which is provided on the cabinet (37) and appears to be open and the electronic lock is switched to closed position by turning the handle (10). Then, when it is intended to unlock the electronic lock, again "1234" is entered as the password and the electronic lock is switched to open position by turning the handle (10) in the reverse of the closing direction.

The battery (30) inside the electronic lock is not active during the sale. Therefore, the processor does not operate, either. As already mentioned, a port (energy harvesting outlet (19*a*1)) which outputs the energy it harvests is provided inside the dynamic NFC tag chip (19*a*) and this port is used for feeding the processor (34). The advantage of the dynamic NFC tag chip (19*a*) is to transfer energy to the processor (34) thanks to the "energy harvesting" outlet thereof. The processor (34) can process the commands—coming from the mobile device (36) thanks to the software contained by the mobile device (36)—again by means of the software contained therein even without the battery (30).

The customers buying the electronic lock may purchase, for example, 500 electronic locks and request 150 of them to have different administrator passwords and 300 to have different administrator passwords. In such case, different passwords can be designated to the electronic locks by means of the mobile device (36). The electronic lock may not have energy during password designation. The changes are recorded in the processor (34) by allowing the processor (34) to operate with the energy supplied through the energy harvesting outlet (19*a*1) of the dynamic NFC tag chip (19*a*).

In an alternative embodiment of the invention, there may not be a keypad (18) on the electronic lock and the mobile device (36) can be used instead of the keypad (18). The password can be entered via the mobile device (36). When the NFC-compatible mobile device (36) is drawn closer to the electronic lock, thus to the dynamic NFC tag chip (19*a*), the password will be written to the memory of the dynamic NFC tag chip (19*a*) and the processor (34) will read the written password. Provided that the password is correct, the processor (34) will perform the relevant process; provided it is not, the processor will write to the memory the information suggesting that the password is wrong. And, the mobile device (36) will read the data in the memory by means of the software contained therein.

We claim:

1. An electronic lock which is used in doors, covers or drawers and comprises:

in order to allow closing the door, cover or drawer, a latch which connects the electronic lock with the door frame or the cabinet, a rotary shaft which drives said latch and comprises rotary shaft notches located thereon and having recesses therebetween, a roller in which said rotary shaft is located and which enables the electronic lock to be mounted to the door, cover, or drawer, a micro-motor latch which avoids the motion of the rotary shaft by entering into the recesses between said rotary shaft notches or enables the motion of the rotary shaft by coming out of the recesses, a motion transfer member which moves said micro-motor latch upward or downward, a spring gear which is connected to said motion transfer member, a linear motion transfer member which is connected to said spring gear, a worm screw gear on which said linear motion transfer member moves during rotating, a micro-motor which rotates said worm screw gear, a handle which is rotated by the user and connected to the rotary shaft in order to enable said rotary shaft to rotate, characterized in comprising further:

an NFC antenna which is provided on an electronic circuit and allows the signals, which contain therein the functions intended to be realized in the electronic lock and administrator password information and sent by means of the software within the NFC-enabled mobile device to be detected, a dynamic NFC tag chip which is provided on said electronic circuit and connected to said NFC antenna and in which the information, contained by the signals sent by said mobile device and received through the RF wave by means of said NFC antenna, is saved on the memory therein, and which activates the processor by transferring the energy, which it produces from said RF wave by means of the energy harvesting outlet into the feed inlet of the processor by means of a rectifier, said processor which is connected to the dynamic NFC tag chip reads the information inside the memory of said dynamic NFC tag chip by means of the software therein and in response to this information, records data again into the memory of dynamic NFC tag chip or activates said micro-motor; and obtains the information suggesting that the handle is in open position or closed position as a result of the contact between the contact points in different positions on the rotary contact and the electronic circuit.

2. The electronic lock according to the claim 1, characterized in comprising:

a handle button which is located on said electronic circuit behind said handle and pushed thereon by means of the handle, and a coil antenna which is located inside the antenna socket within said handle and connected to the electronic circuit, allows receiving the information in the RF tag provided in the proximity card in order to be read by the processor and to enable the processor to activate the micro-motor depending on the information in the RF tag and the authenticity of the entered password, and is activated by the processor when said handle button is pushed.

3. The electronic lock according to the claim 1, characterized in comprising:

a handle button which is located on said electronic circuit behind said handle and pushed thereon by means of the handle, and an antenna which is located inside said handle and connected to the electronic circuit, allows receiving the information in the RF chip provided in an NFC-compatible card in order to be read by the processor and to enable the processor to activate the micro-motor depending on the information in the RF tag and the authenticity of the entered password, and is activated by the processor when said handle button is pushed.

4. The electronic lock according to the claim 3, characterized in that:

said antenna is a strip antenna or PCB antenna.

* * * * *